US009022100B2

(12) United States Patent
Ciaffarafa et al.

(10) Patent No.: US 9,022,100 B2
(45) Date of Patent: May 5, 2015

(54) ADJUSTABLE TANK FOR BAR-PLATE HEAT EXCHANGER

(75) Inventors: Mario Ciaffarafa, West Yorkshire (GB); Tristram Craig Palmer White, West Yorkshire (GB)

(73) Assignee: DENSO Marston Ltd., West Yorkshire (GB)

( * ) Notice: Subject to any disclaimer, the term of this patent is extended or adjusted under 35 U.S.C. 154(b) by 1044 days.

(21) Appl. No.: 12/947,877

(22) Filed: Nov. 17, 2010

(65) Prior Publication Data

US 2012/0118544 A1 May 17, 2012

(51) Int. Cl.

| | |
|---|---|
| ***F28F 9/02*** | (2006.01) |
| ***F28D 1/03*** | (2006.01) |
| *F28D 21/00* | (2006.01) |

(52) U.S. Cl.

CPC ..... *F28D 1/0366* (2013.01); *F28F 9/0219* (2013.01); *F28F 9/0221* (2013.01); *F28D 2021/008* (2013.01); *F28F 2275/06* (2013.01)

(58) Field of Classification Search

CPC ..... F28F 9/0221; F28F 9/0062; F28B 1/0308
USPC ..... 165/152, 153, 166, 173
See application file for complete search history.

(56) References Cited

U.S. PATENT DOCUMENTS

| | | | | |
|---|---|---|---|---|
| 2,782,009 | A * | 2/1957 | Rippingille | 165/166 |
| 2,899,177 | A * | 8/1959 | Harris et al. | 165/153 |
| 2,912,749 | A * | 11/1959 | Huggins et al. | 29/890.039 |
| 3,231,017 | A * | 1/1966 | Henderson | 165/166 |
| 3,265,129 | A * | 8/1966 | Bawabe | 165/166 |
| 3,517,731 | A * | 6/1970 | Rothman | 165/70 |
| 3,601,185 | A * | 8/1971 | Rothman | 165/166 |
| 4,473,111 | A * | 9/1984 | Steeb | 165/153 |
| 4,681,155 | A * | 7/1987 | Kredo | 165/76 |
| 4,729,428 | A * | 3/1988 | Yasutake et al. | 165/166 |
| 4,804,041 | A * | 2/1989 | Hasegawa et al. | 165/166 |
| 5,292,056 | A * | 3/1994 | Borchert et al. | 228/183 |
| 5,423,112 | A * | 6/1995 | Murphy et al. | 29/890.043 |
| 6,523,605 | B2 | 2/2003 | Doko et al. | |
| 6,729,388 | B2 * | 5/2004 | Emrich et al. | 165/153 |
| 7,726,024 | B2 | 6/2010 | Ishii et al. | |
| 8,276,654 | B2 * | 10/2012 | Zaffetti et al. | 165/166 |
| 2004/0094292 | A1 * | 5/2004 | Meller et al. | 165/175 |
| 2008/0041570 | A1 * | 2/2008 | Abels et al. | 165/148 |
| 2008/0237312 | A1 * | 10/2008 | Watanabe et al. | 228/183 |

FOREIGN PATENT DOCUMENTS

| | | | |
|---|---|---|---|
| JP | 02290691 | A * | 11/1990 |
| JP | 2002-243391 | | 8/2002 |
| JP | 2003334657 | A * | 11/2003 |

OTHER PUBLICATIONS

Kumar et al., "Welding and Welded Connections", section 3.3 from the course syllabus of "Design of Steel Structures I", Indian Institute of Technology (Madras), created/last modified on Jun. 22, 2006, found at: http://nptel.ac.in/courses/IIT-MADRAS/Design_Steel_Structures_I/.*

* cited by examiner

*Primary Examiner* — Allen Flanigan
(74) *Attorney, Agent, or Firm* — Harness, Dickey & Pierce, P.L.C.

(57) ABSTRACT

A heat exchanger includes a core and a pair of end tanks attached to the end of the core. Each end tank extends over an outermost peripheral end of the core such that the core extends into a chamber defined by the end tank. The end tank is welded to the core at the outer surface of the core and a lower end surface of the tank.

19 Claims, 3 Drawing Sheets

ADJUSTABLE TANK FOR BAR-PLATE HEAT EXCHANGER

FIELD

The present disclosure is directed to a heat exchanger having a heat exchanging core and a pair of tanks. More particularly, the present disclosure is directed toward a heat exchanger having tanks which fit over the ends of the heat exchanging core to simplify the welding process and to allow adjustment of the position of the heat exchanging core with respect to the tanks prior to welding.

BACKGROUND

This section provides background information related to the present disclosure which is not necessarily prior art.

A typical heat exchanger includes a brazed heat exchanging core which is comprised of alternate fluid tubes and fins stacked together to form the heat exchanging core. At each open end of the tubes, a tank is provided which abuts the heat exchanging core. The heat exchanging core is typically brazed together and the tanks are typically welded to the heat exchanging core. The heat exchanging core includes side plates that are located on opposite ends of the stacked tubes and fins and the side plates aid in the support for the heat exchanging core. The heat exchanging core further includes a pair of end bar assemblies or header plates through which the tubes extend such that they are in fluid communication with the inside of the tank. One end bar assembly or header tank is disposed on the opposite ends of the tubes and the tanks are welded to the end bars.

During the brazing process for the heat exchanging core, variations in the lengthwise shrinkage of the heat exchanging core may directly affect the dimensions of the completed heat exchanger because the tanks sit directly on the ends of the brazed heat exchanging core. In addition, misalignment of the end bars and the tubes and fins may also prevent the tanks from sitting correctly on the ends of the heat exchanging cores. This necessitates tight tolerances during the manufacture of the heat exchanging core where the lengthwise dimensions of the heat exchanger are critical for its installation in a vehicle, a modular assembly or with interface components.

SUMMARY

This section provides a general summary of the disclosure, and is not a comprehensive disclosure of its full scope or all of its features.

The present disclosure is directed toward a heat exchanger which eliminates or reduces the need to tightly control the dimensional variations of the heat exchanging core including variations in shrinkage between similar heat exchanging cores thus reducing or eliminating the affect on the final dimensions of the heat exchanger. This control of size of the heat exchanger is especially important where the dimensions over the tanks of the heat exchanger are critical.

The heat exchanger of the present disclosure includes tanks which have the open end of the tanks made larger than the end of the heat exchanging core in order that the tank will fit entirely over the end face of the heat exchanging core rather than sit directly on the end of the heat exchanging core. When assembling the tanks to the heat exchanging core, the tanks can be fixed in their intended positions in a jig and the heat exchanging core may be moved in relation to the tanks without affecting the positions of the tanks. Once positioned properly, the tanks are welded to the end bar assemblies of the heat exchanging core to complete the assembly of the tanks and heat exchanging core.

Thus, the above described heat exchanger alleviates the need for tight geometric tolerances on the heat exchanging core ends and on the lower surfaces of the tanks themselves. Also, the position of the weld joint between the tank and the heat exchanging core makes the weld joint inherently smaller in terms of its projection outside the perimeter of the tank which will reduce the clearance required for installation and/or give a greater tolerance for the weld bead height.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
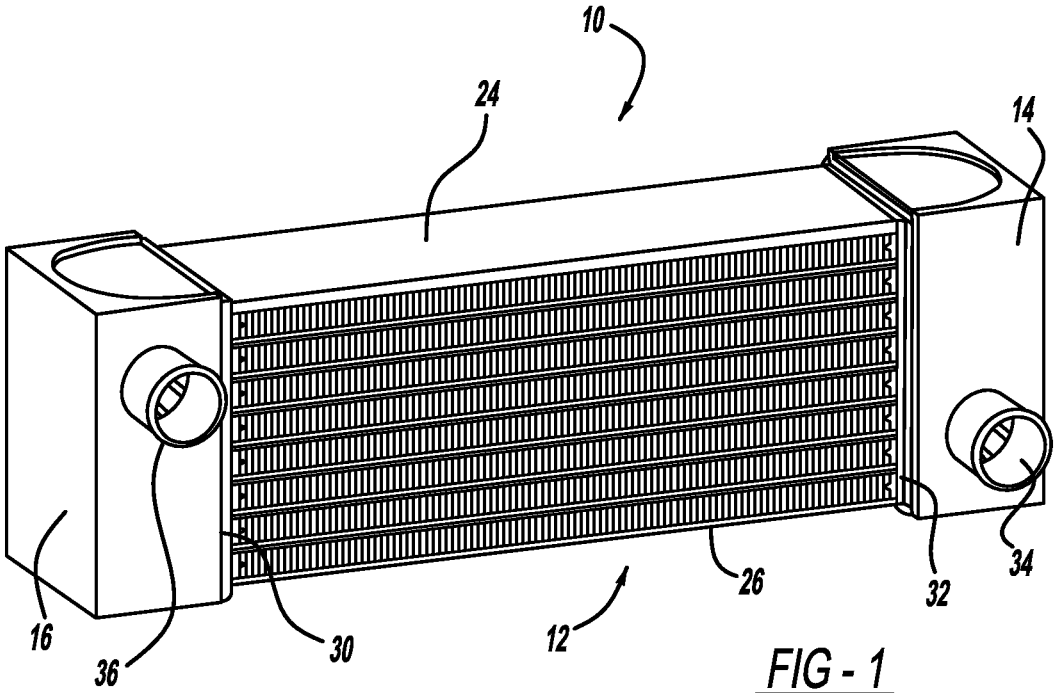
FIG. 1 is a front perspective view illustrating a heat exchanger in accordance with the present disclosure.
Figure 3:
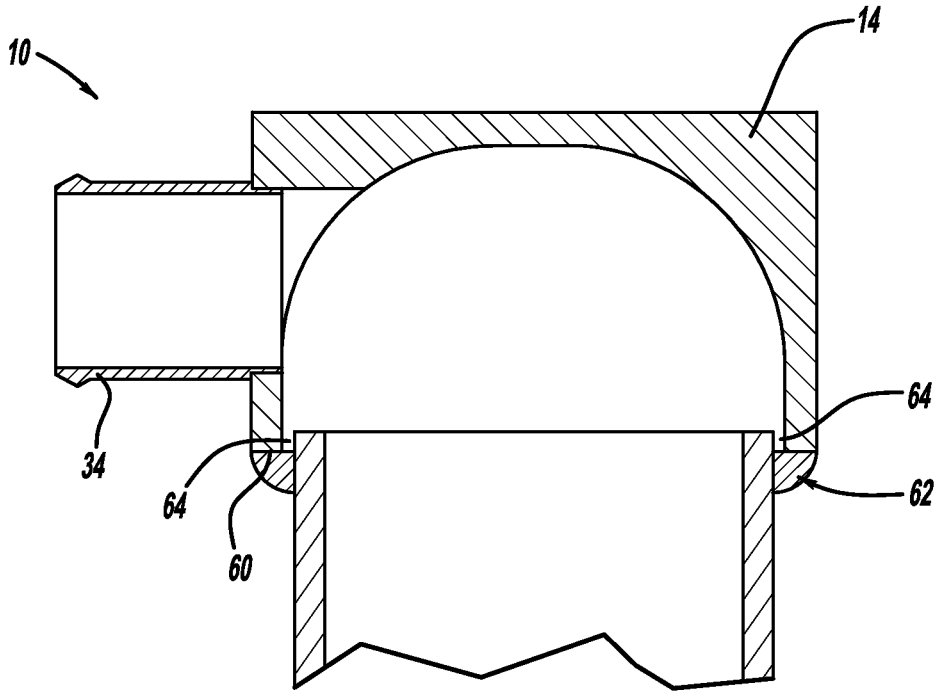
FIG. 3 is a side view partially in cross-section illustrating the connection between the tank and the heat exchanging core in the heat exchanger illustrated in FIG. 1.

Example embodiments will now be described more fully with reference to the accompanying drawings.

A heat exchanger 10 in accordance with the present disclosure is illustrated in FIGS. 1-4. Heat exchanger 10 comprises a heat exchanging core 12, a first end tank 14 and a second end tank 16.

Heat exchanging core 12 comprises a plurality of tube assemblies 20, a plurality of external fins 22, a first side plate 24, a second side plate 26, a first end bar assembly 30 and a second end bar assembly 32. Each of the plurality of fins 22 is located between adjacent tube assemblies 20, between the outermost tube assembly 20 on one side of heat exchanging core 12 and first side plate 24 and between the outermost tube assembly 20 on the opposite side of heat exchanging core 12 and second side plate 26.

Figure 4:
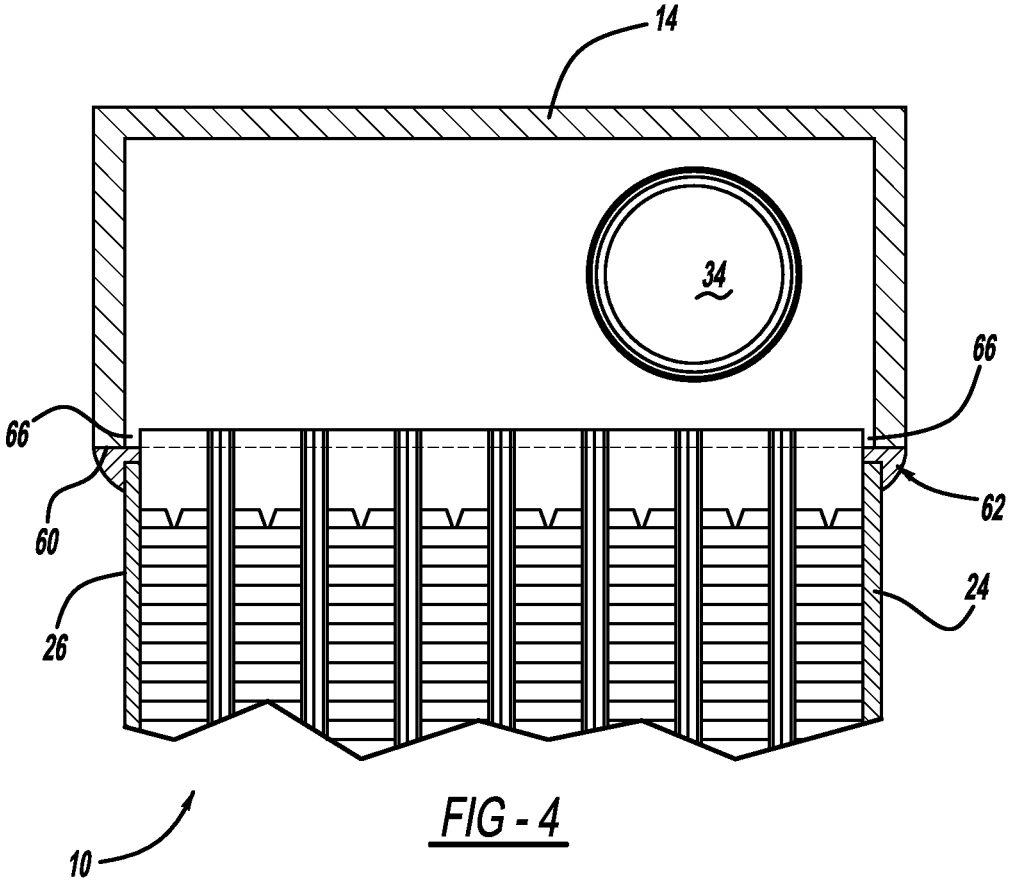
FIG. 4 is a front view partially in cross-section illustrating the connection between the tank and the heat exchanging core in the heat exchanger illustrated in FIG. 1.

Each side plate 24, 26 is disposed on an outer end of the heat exchanging core 12 to provide additional strength to heat exchanger 10. As illustrated in FIGS. 1 and 4, side plates 24 and 26 are shorter than the overall length of heat exchanging core 12 such that a gap is created between each side plate 24, 26 and each end tank 14, 16. These gaps allow for the adjustment of heat exchanging core 12 with respect to end tanks 14 and 16 as well as facilitating the welding of end tanks 14 and 16 to heat exchanging core 12. In addition, the overall width of heat exchanger 10 can be reduced.

Each of the plurality of tube assemblies 20 defines one or more fluid passages which are in communication with an interior chamber defined by first end tank 14 and an interior chamber defined by second end tank 16. First end tank 14 defines an inlet/outlet 34 and second end tank 16 defines an inlet/outlet 36. Fluid flows into inlet/outlet 34, through the interior chamber defined by first end tank 14 and into the passages defined by the plurality of tube assemblies 20. The fluid flows out of the plurality of tube assemblies 20 into the interior chamber defined by second end tank 16 and out through inlet/outlet 36. While fluid flow through heat exchanger 10 is described as being from inlet/outlet 34, to inlet/outlet 36, the flow could be reversed such that fluid is introduced into inlet/outlet 36 and the fluid is removed through inlet/outlet 34.

Figure 2:
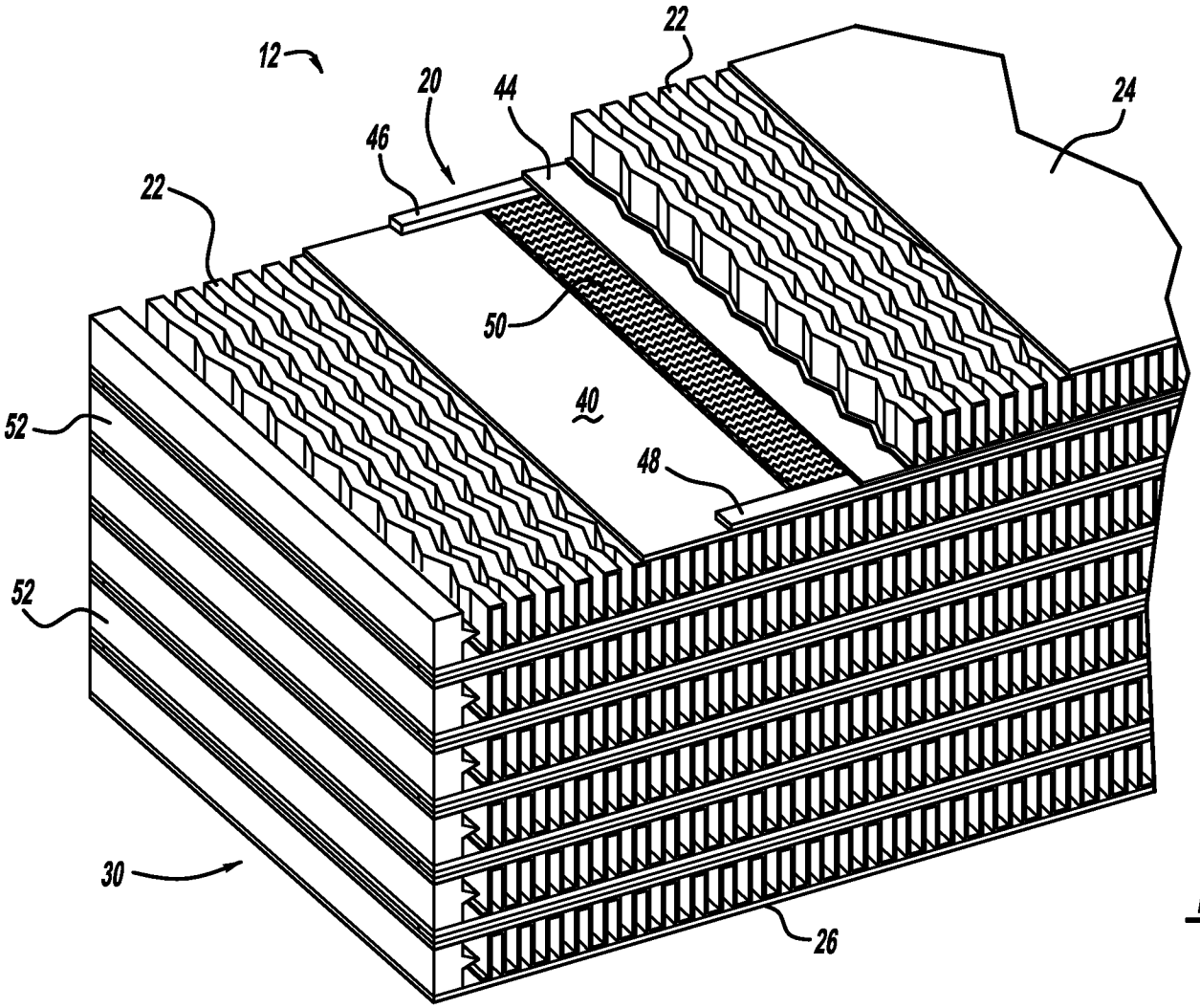
FIG. 2 is a perspective view partially in cross-section of the heat exchanging core of the heat exchanger illustrated in FIG. 1.

As illustrated best in FIG. 2, each of the plurality of tube assemblies 20 comprises a first tube plate 40, a second tube plate 44, a first nose bar 46, a second nose bar 48 and an internal fin 50. First tube plate 40 and second tube plate 44 are disposed adjacent each other with first nose bar 46 being located between first and second tube plates 40 and 44 on one longitudinal end and second nose bar 48 being located between first and second tube plates 40 and 44 at the opposite longitudinal end. This assembly of components creates a fluid passage with internal fin 50 being disposed within the passage between first and second tube plates 40 and 44 and between first and second nose bars 46 and 48.

First and second end bar assemblies 30 and 32 are identical and the description below for first end bar assembly 30 applies also to second end bar assembly 32. While first and second end bar assemblies are illustrated as being identical, it is within the scope of the present disclosure to have first end bar assembly 30 different than second end bar assembly 32. First end bar assembly 30 comprises a plurality of end bars 52 and the plurality of tube assemblies 20. One end bar 52 is disposed between adjacent tube assemblies 20, one end bar 52 is disposed between the outermost tube assembly 20 on one side of heat exchanging core 12 and first side plate 24 and one end bar 52 is disposed between the outermost tube assembly 20 on the opposite side of heat exchanging core 12 and second side plate 26. As illustrated, side plates 24 and 26 do not extend over the entire height of their respective end bar 52. While side plates 24 and 26 are not illustrated as extending over the entire height of end bar 52, side plates 24 and 26 can extend to the top of their respective end bar 52.

The stacking of the plurality of end bars 52 and the plurality of tube assemblies 20 provides a solid exterior or peripheral surface of end bar assembly 30 to which first end tank 14 is welded as described below. This solid, uninterrupted surface is comprised of the plurality of end bars 52, first and second tube plates 40 and 44 and first and second nose bars 46 and 48. These components are attached to each other by bonding, brazing, welding or by other method known in the art. If side plates 24 and 26 extend over the entire height of their respective end bar 52, the solid, uninterrupted peripheral surface of end bar assembly 30 would include side plates 24 and 26. By having side plates 24 and 26 extend over only a portion of the height of their respective end bar 52, the overall width of heat exchanger 10 can be reduced. While the present disclosure is described using end bar assemblies 30 and 32, end bar assemblies 30 and 32 can be replaced by a single piece header plate and the plurality of tube assemblies 20 can be replaced by a plurality of formed tubes.

First end tank 14 is attached to end bar assembly 30 preferably by welding, but other attachments including, but not limited to, bonding or brazing can be utilized. The inside periphery of first end tank 14 is designed to extend over the entire peripheral surface of end bar assembly 30 as illustrated in the drawings such that end bar assembly 30 of heat exchanging core 12 is disposed within a chamber defined by first end tank 14. The outer peripheral surface of end bar assembly 30 and an end surface 60 of first end tank 14 form a generally right angle which provides a corner 62 for use in the welding of first end tank 14 to end bar assembly 30. As illustrated, the inside periphery of first end tank 14 is a specified dimension wider and a specified dimension longer than the outer periphery of end bar assembly 30. This provides gaps 64 in the width direction of heat exchanging core 12 and gaps 66 in the length direction of heat exchanging core 12 which allows adjustment of the position of heat exchanging core 12 with respect to first end tank 14.

In the prior art heat exchangers, the outer dimensions of the tank were the same as the outer dimensions of the end bar assembly. When the tank was placed on the end bar assembly, a seam for welding was created between the top outer periphery of the end bar assembly and the bottom outer periphery of the tank. The assembly was welded at this seam with the weld bead extending outward from the peripheral surfaces. In the present disclosure, the weld bead is at corner 62 below end surface 60 of first end tank 14 and the weld bead can be contained inside the outer periphery of first end tank 14. In addition, in the prior art, the overall height or length of the heat exchanger is determined by the height or length of the core and the two end tanks because they are stacked end to end for welding. Thus, the overall height or length includes a stack-up of the tolerances of each of the components. In the present disclosure, the overall height or length of heat exchanger 10 can be set by a fixture which holds first and second end tanks 14 and 16. Heat exchanging core 12 can then be assembled into first and second end tanks 14 and 16. Because heat exchanging core 12 extends into first and second end tanks 14 and 16, first and second end tanks 14 and 16 can be held at the desired overall dimensions with the tolerances of the individual components being compensated for by the height or length of engagement between the outer surfaces of end bar assemblies 30 and 32 and the interior surfaces of their respective first and second end tanks 14 and 16.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat exchanger comprising:

a heat exchanging core;

a first tank attached to said heat exchanging core;

a second tank attached to said heat exchanging core; wherein said first tank engages an outermost peripheral surface of a first end of said heat exchanging core, said heat exchanging core includes side plates disposed on an outer end of the heat exchanging core and a plurality of tubes projecting in the longitudinal direction of the tubes from the side plates, a dimension of an interior chamber defined by the first tank in a width direction of the tubes is longer than a width of the tubes, a dimension of the interior chamber defined by the first tank in a stacking direction of the tubes is longer than a dimension of the heat exchanging core in the stacking direction of the tubes without the side plates, the dimension of the interior chamber defined by the first tank in the stacking direction of the tubes is shorter than a dimension of the heat exchanging core in the stacking direction of the tubes with the side plates, and the side plates in the longitudinal direction of the tubes are shorter than an overall length of the tubes in the longitudinal direction of the tubes.

2. The heat exchanger according to claim 1, wherein said heat exchanging core includes an end bar assembly, said first tank encircling an outermost peripheral surface of said end bar assembly.

3. The heat exchanger according to claim 2, wherein said first tank fully encircles said outermost peripheral surface of said end bar assembly.

4. The heat exchanger according to claim 2, wherein said first end of said heat exchanging core is disposed within the interior chamber defined by said first tank.

5. The heat exchanger according to claim 2, wherein the engagement between said first end tank and said heat exchanging core defines a generally perpendicular corner, a weld securing said first tank to said heat exchanging core being disposed in said corner.

6. The heat exchanger according to claim 1, wherein said heat exchanging core comprises:

an end bar assembly; and a passage defined by each of said plurality of tubes being in communication with an internal chamber defined by said first tank; wherein said first tank encircles an outermost periphery of said end bar assembly, and said plurality of tubes extending through said end bar assembly.

7. The heat exchanger according to claim 6, wherein said first tank fully encircles said outermost peripheral surface of said end bar assembly.

8. The heat exchanger according to claim 6, wherein said first end of said heat exchanging core is disposed within the interior chamber defined by said first tank.

9. The heat exchanger according to claim 6, wherein the engagement between said first end tank and said heat exchanging core defines a generally perpendicular corner, a weld securing said first tank to said heat exchanging core being disposed in said corner.

10. The heat exchanger according to claim 1, wherein said first tank fully encircles said outermost peripheral surface of said first end of said heat exchanging core.

11. The heat exchanger according to claim 1, wherein said first end of said heat exchanging core is disposed within the interior chamber defined by said first tank.

12. The heat exchanger according to claim 1, wherein the engagement between said first end tank and said heat exchanging core defines a generally perpendicular corner, a weld securing said first tank to said heat exchanging core being disposed in said corner.

13. The heat exchanger according to claim 1, wherein said second tank engages an outermost peripheral surface of a second end of said heat exchanging core.

14. The heat exchanger according to claim 13, wherein said heat exchanging core includes a first and a second end bar assembly, said first tank encircling an outermost peripheral surface of said first end bar assembly, said second tank encircling an outermost peripheral surface of said second end bar assembly.

15. The heat exchanger according to claim 13, wherein said first tank fully encircles said outermost peripheral surface of said first end of said heat exchanging core and said second tank fully encircles said outermost peripheral surface of said second end of said heat exchanging core.

16. The heat exchanger according to claim 13, wherein said first end of said heat exchanging core is disposed within the interior chamber defined by said first tank and said second end of said heat exchanging core is disposed within the interior chamber defined by said second tank.

17. The heat exchanger according to claim 13, wherein the engagement between said first end tank and said heat exchanging core defines a first generally perpendicular corner, a first weld securing said first tank to said heat exchanging core being disposed in said first corner; and the engagement between said second end tank and said heat exchanging core defines a second generally perpendicular corner, a second weld securing said second tank to said heat exchanging core being disposed in said second corner.

18. The heat exchanger according to claim 1, wherein:

the heat exchanging core includes a second plurality of end bars separate from the plurality of tube assemblies each of said second plurality of end bars being disposed between and directly engaging said adjacent tube assemblies and a second pair of end bars separate from said plurality of tube assemblies, each of said second pair of end bars being disposed between and directly engaging said one of said pair of side plates and said end one of said plurality of tube assemblies.

19. The heat exchanger according to claim 2, wherein the first tank overlaps with the outermost peripheral surface of said end bar assembly and does not overlap with an outermost peripheral surface of said side plates.

* * * * *